United States Patent [19]

Itou et al.

[11] Patent Number: 4,651,054

[45] Date of Patent: Mar. 17, 1987

[54] COLOR PICTURE TUBE

[75] Inventors: Takeo Itou; Norio Koike; Seiji Sagow, all of Fukaya, Japan

[73] Assignee: Kabushiki Kaisha Toshiba, Kawasaki, Japan

[21] Appl. No.: 616,896

[22] Filed: Jun. 4, 1984

[30] Foreign Application Priority Data

Jun. 29, 1983 [JP] Japan ..... 58-115976

[51] Int. Cl.[4] ..... H01J 29/20

[52] U.S. Cl. ..... 313/468; 313/467

[58] Field of Search ..... 313/468, 467

[56] References Cited

U.S. PATENT DOCUMENTS

| | | | |
|---|---|---|---|
| 3,825,436 | 7/1974 | Buchanan et al. | 313/468 X |
| 4,088,921 | 5/1978 | Layman et al. | 313/467 |
| 4,140,940 | 2/1979 | Uehara et al. | 313/468 X |

FOREIGN PATENT DOCUMENTS

| | | | |
|---|---|---|---|
| 2732405 | 8/1979 | Fed. Rep. of Germany . | |
| 52053 | 5/1978 | Japan | 313/468 |
| 21227 | 5/1982 | Japan . | |

*Primary Examiner*—Palmer C. DeMeo

*Attorney, Agent, or Firm*—Cushman, Darby and Cushman

[57] ABSTRACT

A color picture tube fitted with a phosphor screen formed of a green-emitting phosphor prepared from copper and aluminum-activated zinc sulfide, a red-emitting phosphor prepared from europium-activated yttrium oxysulfide, and a blue-emitting phosphor prepared from silver-activated zinc sulfide, and wherein the copper concentration ranges between 0.01 and 0.03% by weight and the europium concentration ranges between 5.1 and 6.1% by weight.

1 Claim, 7 Drawing Figures

COLOR PICTURE TUBE

BACKGROUND OF THE INVENTION

This invention relates to a color picture tube, and more particularly to that type whose phosphor screen has its color reproducibility noticeably improved. The most important characteristics of a color picture tube are represented by color brightness, color contrast and the purity or reproducibility of each of the green, blue and red colors. These characteristics largely depend on the light-emitting property of a phosphor material. To date, however, no combination of blue, green and red color-emitting phosphor materials has been developed which can fully realize the aforementioned characteristics. Hitherto, phosphor materials have been selected with most importance attached to the brightness of their colors. A known phosphorescent assembly providing the brightest phosphorescent screen is represented by a combination of a green-emitting phosphor ZnS: Cu, Au, Al, a blue-emitting phosphor ZnS: Ag, Cl and a red-emitting phosphor $Y_2O_2S$: Eu. Except for the blue-emitting phosphor ZnS: Ag, Cl, the green and red-emitting phosphor cannot be considered to give a sufficient color purity. To elevate the brightness of a red-emitting phosphor, it is possible to use a slightly orange-tinged red phosphor. In this case, it is possible to obtain a sufficiently bright white picture by mixing a slightly yellowish green-emitting phosphor with the above-mentioned orange-tinged red phosphor. However such attempt is accompanied with a loss of hue and saturation thus failing to ensure faithful color reproducibility. Further, a red phosphor having deep saturation is too reduced in brightness for practical application.

SUMMARY OF THE INVENTION

Accordingly, it is the object of this invention to provide a color picture tube fitted with a phosphor screen which ensures improvement in color reproducibility with little loss of brightness.

To attain the above-mentioned object, the invention provides a color picture tube which comprises a green-emitting phosphor consisting of copper and aluminum-activated zinc sulfide (ZnS: Cu, Al), a red-emitting phosphor consisting of europium-activated yttrium oxysulfide ($Y_2O_2S$: Eu), and a blue-emitting phosphor consisting of silver-activated zinc sulfide (ZnS: Ag), and wherein the copper has a concentration of 0.01 to 0.03% by weight, and the europium has a concentration of 5.1 to 6.1% by weight. It will be noted that the above-mentioned copper concentration denotes that of the copper contained in the green-emitting phosphor, and the above-mentioned europium concentration represents that of the europium contained in the red-emitting phosphor.

DETAILED DESCRIPTION OF THE PREFERRED EMBODIMENT

Figure 1:
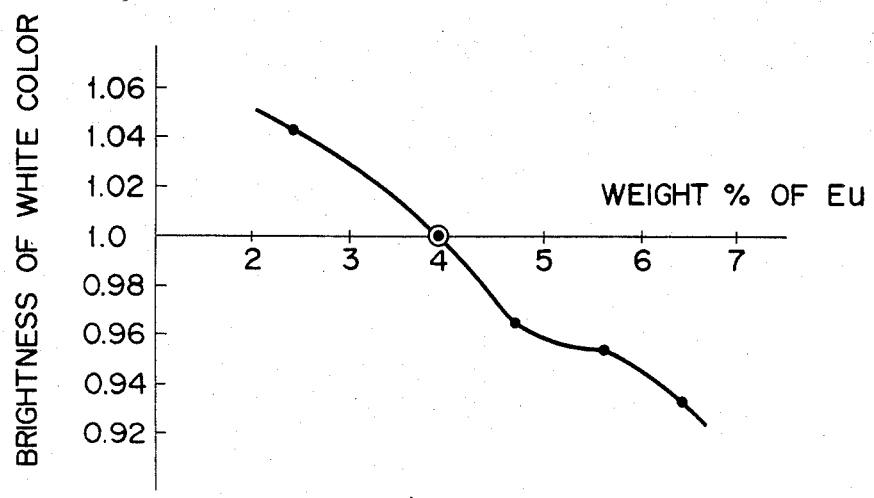
FIG. 1 is a curve diagram showing the relationship between the concentration of europium and the brightness of a white color.
Figure 2:
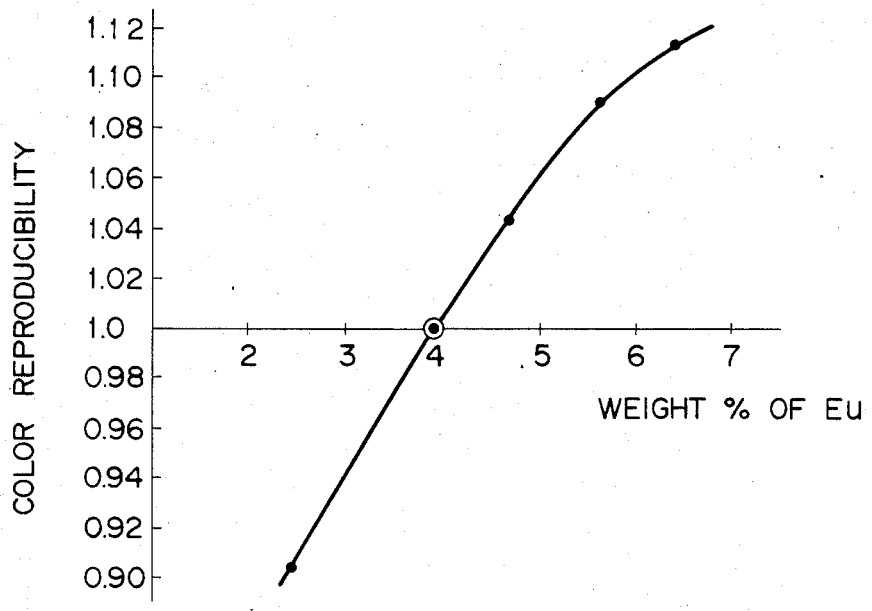
FIG. 2 is a curve diagram indicating the relationship between the concentration of europium and color reproducibility.

FIG. 1 shows the relationship between the varying Eu concentrations in the red-emitting phosphor and the brightness of a white color appearing on a color picture tube. FIG. 2 indicates the relationship between said varying Eu concentrations and the corresponding color reproducibility. The Ag concentration of a blue-emitting phosphor ZnS: Ag (permissibly containing Cl or Al) ranges from 0.015% by weight to 0.022% by weight or typically 0.02% by weight. A green-emitting phosphor, combined with the red-emitting phosphor, consists of ZnS: Cu, Au, Al (Cu 0.01% by weight and Au 0.05% by weight). A dot enclosed in a circle (FIGS. 1 and 2) shows that the Eu concentration of the red-emitting phosphor $Y_2O_2S$: Eu is 3.9% by weight.

As seen from FIGS. 1 and 2, the brightness of a white color progressively dropped as the Eu concentration rose, and the color reproducibility was elevated almost proportionally.

The fundamental object of this invention is to ensure the maximum elevation of color reproducibility with, minimum loss of brightness. To this end, a determination was made of a parameter expressed by the following equation:

$$P = \frac{\text{Increase in color reproducibility}}{\text{Decrease in white color brightness}}$$

Figure 3:
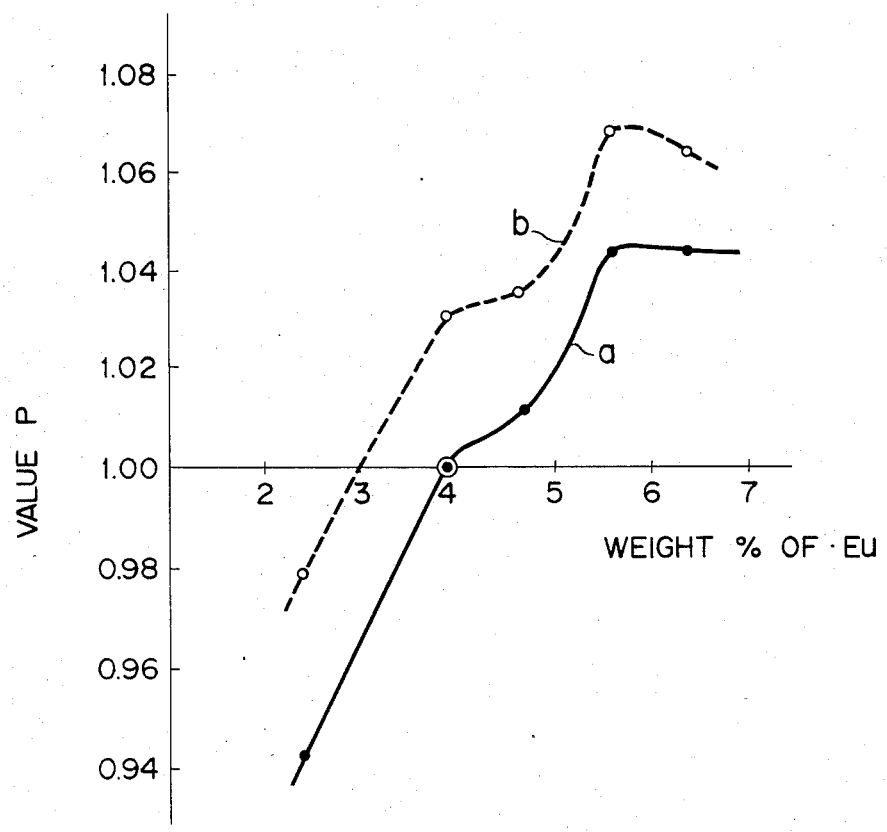
FIG. 3 is a curve diagram representing the relationship between the concentration of europium and the value P of a comparison between an increase in color reproducibility and a decrease in the brightness of a white color.

The results of the above-mentioned determination are set forth in FIG. 3, which shows that though P progressively increases with a rise in the Eu concentration, P reaches a peak in the proximity of the Eu concentration of 5.6% by weight and retains the same level at a higher Eu concentration than 5.6% by weight or conversely tends to fall. Curve a of FIG. 3 represents the result of a control consisting of a conventional green-emitting phosphor ZnS: Cu, Au, Al (Cu 0.01% by weight and Au 0.05% by weight) combined with a red-emitting phosphor $Y_2O_2S$: Eu, and curve b shows the result of a combination embodying this invention, namely, a green-emitting phosphor ZnS: Cu, Al (Cu 0.025% by weight) combined with a red-emitting phosphor $Y_2O_2S$: Eu. The blue-emitting phosphor ZnS: Ag (Ag 0.02% by weight) was used in said control and also in the phosphor embodying this invention.

The above-mentioned experiments show that if Eu is applied at a concentration of at least 5.1% by weight higher than the conventional representative Eu concentration of 3.9% by weight, it is possible to increase color reproducibility most effectively.

When, therefore, trying to produce a color picture tube while considering the high cost of europium and also ensuring manufacturing efficiency, it may be concluded that the concentration of europium should preparably range between 5.1 and 6.1% by weight.

Figure 4:
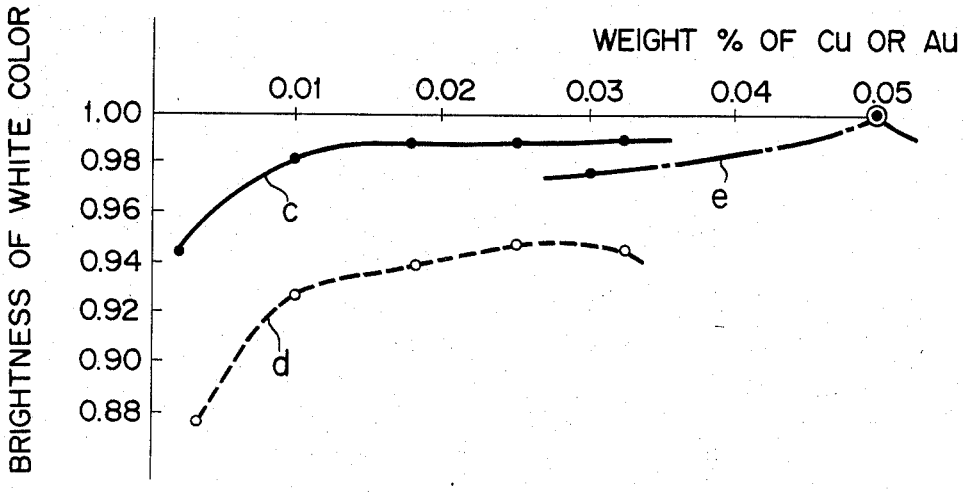
FIG. 4 is a curve diagram setting forth the relationship between the concentration of copper or gold and the brightness of a white color.
Figure 5:
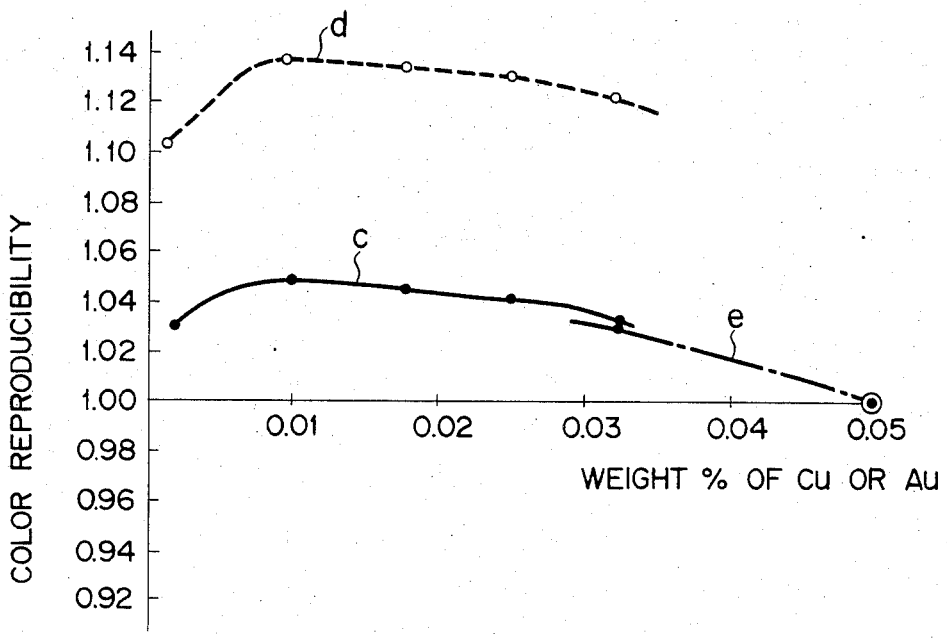
FIG. 5 is a curve diagram showing the relationship between the concentration of copper or gold and the level of color reproducibility.
Figure 6:
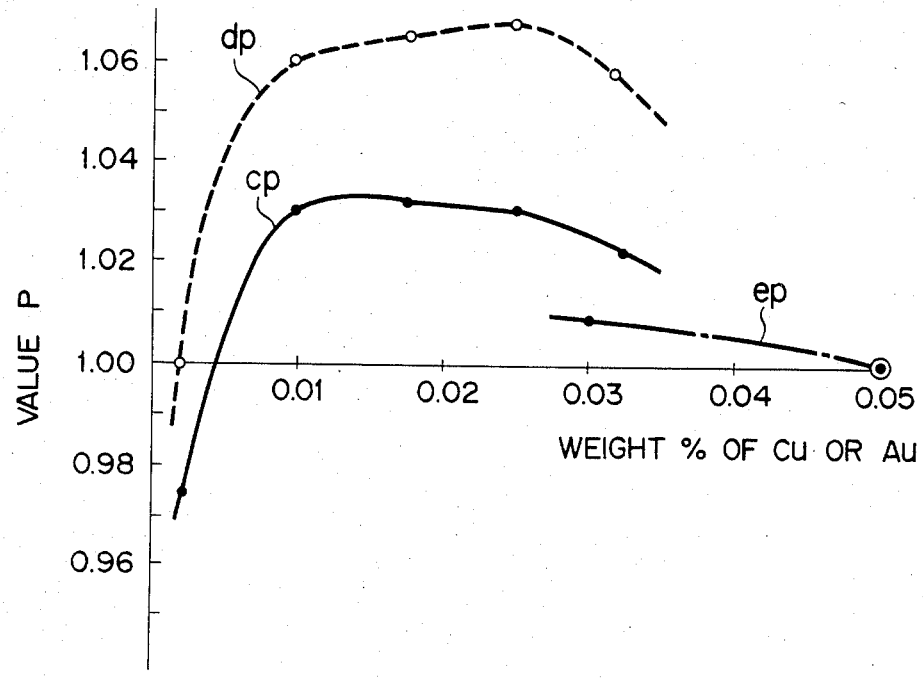
FIG. 6 is a curve diagram denoting the relationship between the concentration of copper or gold and the value P of a comparison between an increases in color reproducibility and a decrease in the brightness of a white color.

Determination white color brightness and color reproducibility was made by increasing or decreasing the concentration of an activator Cu or Au is green-emitting phosphor ZnS: Cu, Au, Al and ZnS: Cu, Al, and the results are set forth in the curve diagrams of FIGS. 4 and 5. Curve C denotes a control, namely, a combination of a red-emitting phosphor $Y_2O_2S$: Eu (the concentration of Eu being set at the representative value of 3.9% by weight applied to the phosphorescent screen of the conventional color picture tube) and a green-emitting phosphor ZnS: Cu, Al (Al concentration being fixed and Cu concentration being rendered variable). Curve d represents an embodiment of this invention, that is, a combination of a red-emitting phosphor $Y_2O_2S$: Eu (Eu 5.6% by weight) and a green-emitting phosphor ZnS: Cu, Al (Al concentration being fixed and Cu concentration being rendered variable). Curve e shows a control, that is, a combination of a red-emitting phosphor $Y_2O_2S$: Eu (Eu 3.9% by weight) and a green-emitting phosphor ZnS: Cu, Au, Al (Cu 0.01% by weight and Au concentration being rendered variable). A blue-emitting phosphor ZnS: Ag (Ag 0.02% by weight) was applied in this invention as well as in the two controls. Through FIGS. 4 and 5 dots enclosed in a circle indicate the representative conventional combination of $Y_2O_2S$: Eu (Eu 3.9% by weight) and ZnS: Cu, Au, Al (Cu 0.01% by weight and Au 0.05% by weight). Further, a parameter was determined in the same manner as in FIG. 3, and the results are set forth in FIG. 6. Curves cp, dp, ep denote the values of P corresponding to the curves, c, d, e shown in FIGS. 4 and 5. Curve dp, representing ZnS: Cu, Al, advantageously indicated a higher P value on the whole than curve ep, denoting ZnS: Cu, Au, Al (Cu concentration being fixed at 0.01% by weight). With respect to curve cp, denoting ZnS: Cu, Al, the P value depends on the concentration of Cu, while the concentration by Cu ranges between about 0.01% by weight and about 0.025% by weight, the p value changes little namely, it stands at a maximum value of 1.03.

As seen from the above-mentioned experiment's results, a combination of a red-emitting phosphor $Y_2O_2S$: Eu (Eu concentration being set at a high level ranging between 5.1 and 6.1% by weight) and a green-emitting phosphor ZnS: Cu, Al, (Cu concentration ranging between 0.01 and 0.03% by weight) provided a color picture tube which was increased as much as about 13% in color reproducibility with a slight decline of about 5.7% in brightness.

This invention will be better understood from the following description of experiments.

TEST 1

A phosphor screen was produced from:

a phosphor assembly A (a control) having the highest brightness prepared from a green-emitting phosphor ZnS: Cu, Au, Al (Cu concentration 0.01% by weight and Au concentration 0.05% by weight) and a red-emitting phosphor $Y_2O_2S$: Eu (Eu concentration 2.4% by weight);

a phosphor assembly B (a control) having the highest color reproducibility prepared from a green-emitting phosphor ZnS: Cu, Al (Cu concentration 0.01% by weight) and a red-emitting phosphor $Y_2O_2S$: Eu (Eu concentration 6.4% by weight);

a phosphor assembly C (a control) prepared from a green-emitting phosphor ZnS: Cu, Au, Al (Cu concentration 0.01% by weight and Au concentration 0.05% by weight) and a red-emitting phosphor $Y_2O_2S$: Eu (Eu concentration 3.9% by weight); and a phosphor assembly D (an example embodying this invention) prepared from a green-emitting phosphor ZnS: Cu, Al (Cu concentration 0.025% by weight) and a red-emitting phosphor $Y_2O_2S$: Eu (Eu concentration 5.6% by weight).

Ten men, whose ages ranged from 20 to 40 years, were asked to make an overall evaluation of the picture quality of an actually fitted color picture tube, provided with each of the above-mentioned phosphor assemblies A, B, C, D, in respect of white color brightness and color reproducibility. It will be noted that a blue-emitting phosphor ZnS: Ag (Ag 0.02% by weight) was applied in common to the above-mentioned phosphor assemblies A, B, C, D.

Figure 7:
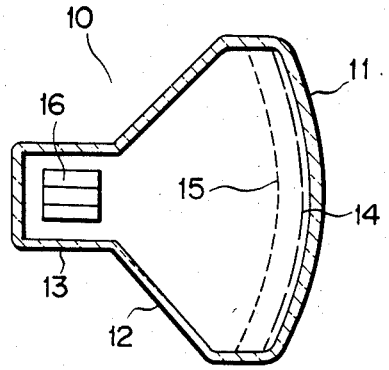
FIG. 7 is a substantially cross sectional view of a color picture tube embodying this invention.

As shown in FIG. 7, a color picture tube 10 generally comprises an envelope formed of a panel 11, funnel 12 and neck 13; a phosphor screen 14 coated on the inner surface of the panel 11; a slit type shadow mask 15 set close to the inner surface of said phosphor screen 14; and an electron gun 16 provided in the neck 13 to emit three electron beams to the shadow mask 15. The three electron beams selectively excite the phosphor screen 14 by means of the shadow mask 15. A plurality of vertically extending red, green and blue light-emitting stripes are formed in parallel with an equal width on the phosphor screen 14 in the order mentioned. Table 1 below shows the results of the evaluation by the aforesaid ten men of the color picture tube 10 fitted with each of the previously described phosphor assemblies A, B, C, D.

TABLE 1

| Phosphor Assemblies | A | B | C | D |
|---|---|---|---|---|
| White color brightness | +4 | −10 | standard | −5 |
| Color reproducibility | −9.5 | +16 | standard | +13 |
| Overall picture quality | X | Δ | ○ | ◎ |

The phosphor assembly A showed only yellowish green and orange-tinged red, though having a good brightness. When a picture bearing such colors appeared, the men strongly sensed that the true primany colors were noticeably lacking, and consequently rated the phosphor assembly A as ×, namely, utterly unacceptable. The phosphor assembly B noticeably decreased in brightness, though indicating good color reproducibility, and showed a picture quality reduced in contrast due to a failure to exhibit the prominent expansion of a white peak. Thus, the phosphor assembly B was marked with Δ, namely, rated as unsatisfactory. The phosphor assembly C was marked with ○, namely evaluated as practically acceptable. In contrast, the phosphor assembly D embodying this invention indicated a slightly observable decline in brightness and a small lack of contrast. However, said phosphor assembly D was noticeably improved in color purity and was marked with ◎, namely, considered to present the most excellent picture quality on the whole.

TEST 2

Phosphor assemblies were formed substantially in the same manner as in TEST 1, except that a red-emitting phosphore $Y_2O_2S$: Eu containing 0.1% by weight of a pigment of red iron oxide was applied.

A phosphor assembly E (a control) having the highest brightness was prepared from a green-emitting phosphor ZnS: Cu, Au, Al (Cu concentration 0.01% by weight and Au concentration 0.05% by weight), and a red-emitting phosphor $Y_2O_2S$: Eu (containing 0.1% by weight of red iron oxide pigment and 2.1% by weight of Eu).

A phosphor assembly F (a control having the highest color reproducibility was prepared from a green-emitting phosphor ZnS: Cu, Al (Cu concentration 0.01% by weight and a red-emitting phosphor $Y_2O_2S$: Eu (Eu concentration 6.1% by weight) containing 0.1% by weight by red iron oxide pigment.

A phosphor assembly G (a control) was prepared from a green-emitting phosphor ZnS: Cu, Au, Al (Cu concentration 0.01% by weight and Au concentration 0.05% by weight) and a red-emitting phosphor $Y_2O_2S$: Eu (Eu concentration 3.6% by weight) containing 0.1% by weight of red iron oxide pigment.

A phosphor assembly H of this invention having a maximum P value was prepared from a green-emitting phosphor ZnS: Cu, Al (Cu concentration 0.025% by weight) and a red-emitting phosphor $Y_2O_2S$: Eu (Eu concentration 5.3% by weight) containing 0.1% by weight of red iron oxide pigment.

An overall evaluation was made on the above-mentioned phosphor assemblies E, F, G, H applied to a phosphor screen put into practical operation in respect of the brightness of a white color and color reproducibility. Table 2 below shows the results of said evaluation.

TABLE 2

| Phosphor Assemblies | E | F | G | H |
|---|---|---|---|---|
| White color brightness | +5 | −11 | standard | −4 |
| Color reproducibility | −10 | +15 | standard | +14 |
| Overall picture quality | X | Δ | ○ | ◎ |

As seen from Table 2 above, the overall evaluation of the above-mentioned four phosphor assemblies E, F, G and H provded that, as in TEST 1, a color picture tube provided with a phosphor screen coated with the phosphor assembly H embodying this invention indicates the best picture quality.

What is claimed is:

1. A phosphor composition of improved color reproducibility for a color picture tube consisting essentially of:

a green-emitting phosphor formed of copper and aluminum-activated zinc sulfide, a red-emitting phosphor formed of europium-activated yttrium oxysulfide, and a blue-emitting phosphor formed of silver-activated zinc sulfide, and wherein the copper concentration is set at 0.01 to 0.03% by weight and the europium concentration is set at 5.1 to 6.1% by weight.

* * * * *